US010240103B2

(12) United States Patent
Takane et al.

(10) Patent No.: US 10,240,103 B2
(45) Date of Patent: Mar. 26, 2019

(54) GREASE COMPOSITION FOR BEARING

(71) Applicant: IDEMITSU KOSAN CO., LTD., Chiyoda-ku (JP)

(72) Inventors: Kouji Takane, Ichihara (JP); Yukitoshi Fujinami, Ichihara (JP); Hiroki Sekiguchi, Ichihara (JP); Yusuke Nakanishi, Sodegaura (JP); Yoshiyuki Suetsugu, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/769,937

(22) PCT Filed: Mar. 12, 2014

(86) PCT No.: PCT/JP2014/056565

§ 371 (c)(1),
(2) Date: Aug. 24, 2015

(87) PCT Pub. No.: WO2014/142198

PCT Pub. Date: Sep. 18, 2014

(65) Prior Publication Data

US 2016/0002558 A1 Jan. 7, 2016

(30) Foreign Application Priority Data

Mar. 14, 2013 (JP) ..... 2013-051925

(51) Int. Cl.
*C10M 169/00* (2006.01)
*C10M 115/08* (2006.01)
*C10M 169/02* (2006.01)

(52) U.S. Cl.
CPC ..... *C10M 115/08* (2013.01); *C10M 169/02* (2013.01); *C10M 2205/0285* (2013.01);
(Continued)

(58) Field of Classification Search
CPC ..... C10M 115/08; C10M 169/02; C10M 2207/2855; C10M 2205/0285;
(Continued)

(56) References Cited

U.S. PATENT DOCUMENTS 6,136,762 A * 10/2000 Yoshinari ..... C07C 273/1827 508/552
2007/0072777 A1 3/2007 Okamura et al.
2014/0121144 A1* 5/2014 Fujinami ..... C10M 169/02 508/481

FOREIGN PATENT DOCUMENTS

CN 101235338 A 8/2008
JP 3-190996 A 8/1991
(Continued)

OTHER PUBLICATIONS

International Search Report dated Apr. 28, 2014, in PCT/JP2014/056565 filed Mar. 12, 2014.
Office Action dated Mar. 2, 2017 in Chinese Patent Application No. 201480014240.5 (with English translation).
Taiwanese Office Action dated Nov. 28, 2017 in connection with corresponding Taiwanese Patent Application No. 103109073, filed Mar. 13, 2014.
(Continued)

*Primary Examiner* — Taiwo Oladapo
(74) *Attorney, Agent, or Firm* — Oblon, McClelland, Maier & Neustadt, L.L.P.

(57) ABSTRACT

A bearing grease composition contains a (A) thickener and a (B) base oil, in which the (A) thickener is a urea thickener represented by a formula (I) below, and, in observation of a transmission image in the bearing grease composition, a transmission-image-area ratio of an aggregation part having a transmission image area exceeding 40 $\mu m^2$ in the urea thickener is 15% or less relative to a total observation area.

$$R^1NHCONHR^2NHCONHR^3 \quad (I)$$

In the formula, $R^1$ and $R^3$ each independently represent: an (a1) monovalent chain hydrocarbon group having 6 to 22 carbon atoms; an (a2) monovalent alicyclic hydrocarbon group having 6 to 12 carbon atoms; and the like, and $R^2$
(Continued)

represents an (a4) divalent aromatic hydrocarbon group having 6 to 15 carbon atoms.

17 Claims, 2 Drawing Sheets

(52) U.S. Cl.
CPC ..... *C10M 2207/2805* (2013.01); *C10M 2207/2845* (2013.01); *C10M 2207/2855* (2013.01); *C10M 2215/1026* (2013.01); *C10N 2230/06* (2013.01); *C10N 2230/08* (2013.01); *C10N 2230/76* (2013.01); *C10N 2240/02* (2013.01); *C10N 2250/10* (2013.01)

(58) Field of Classification Search
CPC .. C10M 2207/2805; C10M 2207/2845; C10M 2215/1026; C10N 2230/76; C10N 2230/06; C10N 2240/02; C10N 2250/10; C10N 2230/08
See application file for complete search history.

(56) References Cited

FOREIGN PATENT DOCUMENTS

| | | | | |
|---|---|---|---|---|
| JP | 3-231993 | A | 10/1991 | |
| JP | 2000-248290 | A | 9/2000 | |
| JP | 2007-211093 | A | 8/2007 | |
| JP | 2008-74978 | A | 4/2008 | |
| JP | 2008-127491 | A | 6/2008 | |
| JP | 2009-197162 | A | 9/2009 | |
| JP | WO 2012165562 | A1 * | 12/2012 | ..... C10M 169/02 |
| TW | 200819529 | | 5/2008 | |
| TW | 201011102 | | 3/2010 | |
| WO | WO 2012/165562 | A1 | 12/2012 | |

OTHER PUBLICATIONS

Office Action dated Jan. 31, 2019, in corresponding European Patent Application No. 14 762 767.3.

* cited by examiner

GREASE COMPOSITION FOR BEARING

RELATED APPLICATION

This application is national stage entry of PCT/JP2014/056565, filed Mar. 12, 2014 which is a continuation of Japanese Patent Application No. 2013-051925, filed Mar. 14, 2013, which are incorporated by reference in their entirety.

TECHNICAL FIELD

The present invention relates to a bearing grease composition, more specifically, to a bearing grease composition suitably usable for bearings of auxiliary machines (e.g., alternator and water pump), a belt pulley bearing, a tension roller bearing, or the like in an internal combustion engine of an automobile.

BACKGROUND ART

In response to demands for a small-sized and light-weight automobile and an enlarged sitting space in the automobile, electric auxiliary machines around engine have also been reduced in size and used near the engine under high temperatures. A bearing grease needs to exhibit a long bearing lubricity lifetime under such severe high-temperature environments. For this reason, the urea grease is often used as the grease having a long bearing lubricity lifetime at high temperatures. For instance, a grease composition using a diurea compound containing an alicyclic amine as a main component has been proposed (Patent Literature 1).

In consideration of the environments and in request for high accuracy and quietness of the bearing, the grease is required to also have a low-noise performance. As urea grease capable of improving the low-noise performance, for instance, a grease composition using a diurea compound containing an aliphatic amine as a main component has been proposed (Patent Literature 2).

CITATION LIST

Patent Literature(s)

Patent Literature 1: JP-A-2009-197162
Patent Literature 2: JP-A-2008-74978

SUMMARY OF THE INVENTION

Problems to be Solved by the Invention

The grease composition disclosed in Patent Literature 1 exhibits an excellent balance between heat resistance and fluidity, thereby prolonging a bearing lubricity lifetime at high temperatures. However, the grease composition disclosed in Patent Literature 1 is liable to form highly crystalline urea thickener particles due to a molecular structure of the grease composition. Thus, when the grease composition is fed in a bearing, noise often becomes large.

On the other hand, in the grease composition disclosed in Patent Literature 2, the urea thickener is not liable to be crystallized, thereby reducing noise as compared with the grease composition having alicyclic amine as the main component. However, as compared with the grease composition having alicyclic amine as the main component, the grease composition disclosed in Patent Literature 2 is liable to leak at high temperatures and exhibits a poor thermal stability, resulting in an unfavorable bearing lubricity lifetime at high temperatures.

Thus, the low-noise performance and the long bearing lubricity lifetime at high temperatures are inconsistent with each other. No grease composition satisfied both of the low-noise performance and the long bearing lubricity lifetime.

An object of the invention is to provide a bearing grease composition capable of satisfying both of low-noise performance and a long bearing lubricity lifetime at high temperatures.

Means for Solving the Problems

In order to solve the above problem, the invention provides the following bearing grease composition.

(1) According to an aspect of the invention, a bearing grease composition includes: an (A) thickener; and a (B) base oil, in which the (A) thickener is a urea thickener represented by a formula (I) below, in observation of a transmission image in a sample with an average thickness of 11 μm of the bearing grease composition, a transmission-image-area ratio of an aggregation part having a transmission image area exceeding 40 $\mu m^2$ in the urea thickener is 15% or less relative to a total observation area, $$R^1NHCONHR^2NHCONHR^3 \quad (I)$$

where: $R^1$ and $R^3$ each independently represent: an (a1) monovalent chain hydrocarbon group having 6 to 22 carbon atoms; an (a2) monovalent alicyclic hydrocarbon group having 6 to 12 carbon atoms; or an (a3) monovalent aromatic hydrocarbon group having 6 to 12 carbon atoms, and $R^2$ represents an (a4) divalent aromatic hydrocarbon group having 6 to 15 carbon atoms.

(2) In the above arrangement, the (a2) monovalent alicyclic hydrocarbon group having 6 to 12 carbon atoms accounts for a range from 60 mol % to 95 mol % in a total amount of $R^1$ and $R^3$ in the formula (I).

(3) In the above arrangement, the (a2) monovalent alicyclic hydrocarbon group having 6 to 12 carbon atoms is a cyclohexyl group, and the rest of the total amount of $R^1$ and $R^3$ in the formula (I) except for the cyclohexyl group is the (a1) monovalent chain hydrocarbon group having 6 to 22 carbon atoms.

(4) In the above arrangement, the (B) base oil is a mixture of a (b1) polyalphaolefin and a (b2) ester.

(5) In the above arrangement, a content of the (b1) polyalphaolefin is in a range from 5 mass % to 95 mass % relative to the (B) base oil of 100 mass %.

(6) In the above arrangement, the (b2) ester is an aromatic ester.

(7) In the above arrangement, a worked penetration of the bearing grease composition is in a range from 200 to 380.

(8) In the above arrangement, the grease composition is used for a bearing for driving an auxiliary machine in an internal combustion engine.

According to the above aspect of the invention, a bearing grease composition capable of satisfying both of low-noise performance and a long bearing lubricity lifetime at high temperatures can be provided.

DESCRIPTION OF EMBODIMENT(S)

Figure 1:
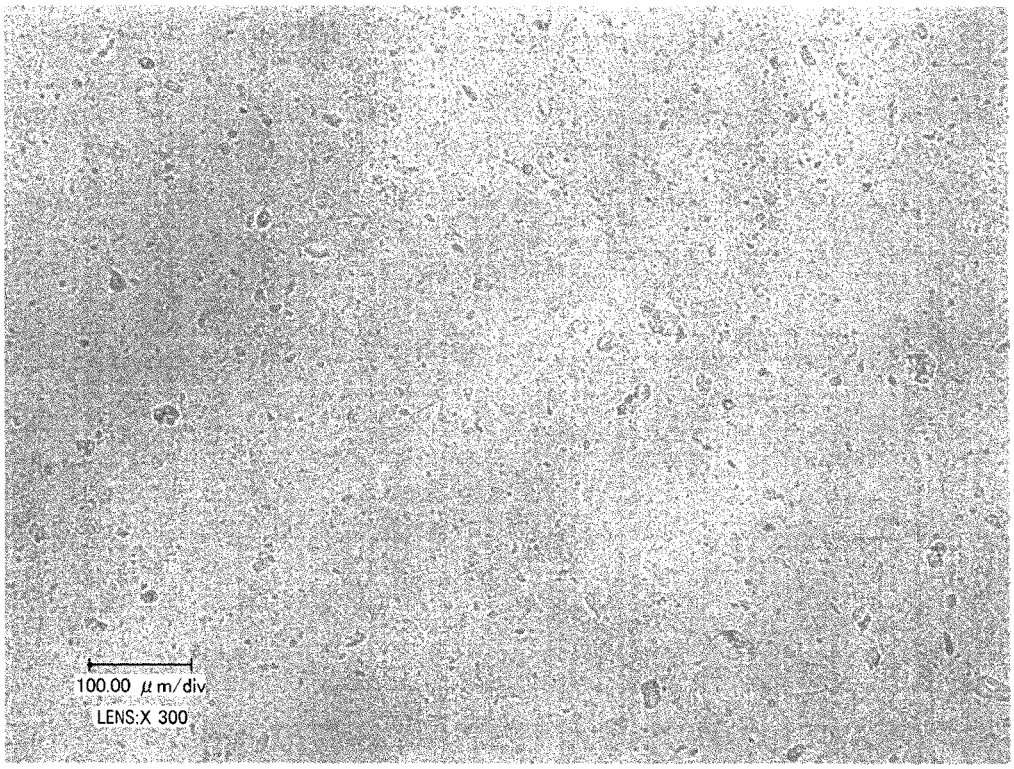
FIG. 1 is a photograph of a transmission image of a grease composition obtained in Example 1, which is taken by an optical microscope.

A bearing grease composition in an exemplary embodiment (hereinafter, occasionally simply referred to as "the present composition") contains a (A) thickener (component (A)) and a (B) base oil (component (B)), in which the (A) thickener is a urea thickener represented by a formula (I), and, in observation of a transmission image in a sample with an average thickness of 11 μm of the bearing grease composition, a transmission-image-area ratio of an aggregation part having a transmission image area exceeding 40 $\mu m^2$ in the urea thickener is 15% or less relative to a total observation area. The exemplary embodiment of the invention will be described below in detail.

In the present composition, in observation of the transmission image in the sample with the average thickness of 11 μm of the bearing grease composition, the transmission-image-area ratio of the aggregation part having the transmission image area exceeding 40 $\mu m^2$ in the urea thickener needs to be 15% or less relative to the total observation area. At the transmission-image-area ratio exceeding 15%, the grease composition exhibits an insufficient low-noise performance. In terms of the low-noise performance, the transmission-image-area ratio is preferably 10% or less, more preferably 8% or less.

In the present composition, the transmission-image-area ratio of the aggregation part having the transmission image area exceeding 40 $\mu m^2$ in the urea thickener, which is obtained by [{(transmission image area of the aggregation part having transmission image area exceeding 40 $\mu m^2$)/(observation area)}×100%], can be calculated as follows. Specifically, the transmission image of the present composition is observed according to a transmission image observation method (i) below. The transmission-image-area ratio of the aggregation part of the urea thickener can be calculated from the obtained transmission image according to an area value calculation method (ii) below.

(i) Transmission Image Observation Method

A sample was prepared by placing a grease composition on a slide glass, putting a spacer with an average thickness of 11 μm on the slide glass, and sandwiching the grease composition with a cover glass. A transmission image of the sample in an observation area of $2\times10^6$ $\mu m^2$ was observed with an optical microscope of 300 magnifications ("Digital Microscope VHX-200/100F" manufactured by KEYENCE CORPORATION).

(ii) Area Value Calculation Method

The transmission image of the aggregation part of the urea thickener in the obtained transmission image (in the observation area of $2\times10^6$ $\mu m^2$) was observed. The transmission-image-area ratio of the aggregation part having the transmission image area exceeding 40 $\mu m^2$ in the urea thickener was calculated from a value of the transmission image area of the aggregation part having the transmission image area exceeding 40 $m^2$ in the total observation area. The aggregation part is a relatively dark part in the transmission image. The transmission image area of the aggregation part can be calculated by converting the transmission image into a binary image using an image analysis software ("Image-Pro PLUS" manufactured by NIPPON ROPER K.K.). In the above calculation, an aggregation part at an end of the observation area and an aggregation part having a sufficiently small transmission image area of 40 $\mu m^2$ or less were excluded.

In the present composition, a means for setting the transmission-image-area ratio of the aggregation part of the urea thickener in the above range is exemplified by a later-described manufacturing method (drop method) of the present composition, in which a reaction temperature, an opening diameter of a drip opening, the number of the drip opening, an addition rate of a solution, an agitation strength and the like are appropriately adjusted.

A worked penetration of the present composition is preferably in a range from 150 to 380, more preferably in a range from 200 to 380, particularly preferably in a range from 200 to 340. When the worked penetration is equal to or more than the lower limit, since the grease is not hard, low-temperature start-up performance is favorable. On the other hand, when the worked penetration is equal to or less than the upper limit, since the grease is not too soft, lubricity is favorable. The worked penetration can be measured by a method defined according to JIS K2220. The worked penetration can be appropriately adjusted by a content of the thickener.

Component A

The (A) thickener is the urea thickener represented by the formula (I) below. As long as the advantages of the invention are not impaired, a diurea compound other than the urea thickener represented by the formula (I) below, monourea compound, triurea compound and tetraurea compound may be used.

$$R^1NHCONHR^2NHCONHR^3 \quad (I)$$

In the formula (1), $R^1$ and $R^3$ each independently represent: an (a1) monovalent chain hydrocarbon group having 6 to 22 carbon atoms, preferably 10 to 22 carbon atoms, more preferably 15 to 22 carbon atoms; an (a2) monovalent alicyclic hydrocarbon group having 6 to 12 carbon atoms, preferably 6 to 8 carbon atoms; or an (a3) monovalent aromatic hydrocarbon group having 6 to 12 carbon atoms. $R^2$ represents an (a4) divalent aromatic hydrocarbon group having 6 to 15 carbon atoms.

Examples of the (a1) monovalent chain hydrocarbon group include a linear or branched and saturated or unsaturated alkyl group, examples of which include linear and branched alkyl groups such as hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, octadecenyl groups, nonadecyl groups and icodecyl groups.

Examples of the (a2) monovalent alicyclic hydrocarbon group include a cyclohexyl group or an alkyl-substituted cyclohexyl groups having 7 to 12 carbon atoms, examples of which include, in addition to the cyclohexyl group, a methyl cyclohexyl group, dimethyl cyclohexyl group, ethyl cyclohexyl group, diethyl cyclohexyl group, propyl cyclohexyl group, isopropyl cyclohexyl group, 1-methyl-propylcyclohexyl group, butyl cyclohexyl group, amyl cyclohexyl group, amyl-methyl cyclohexyl group and hexyl cyclohexyl group. Among the above, in terms of production convenience, the cyclohexyl group, methyl cyclohexyl group, ethyl cyclohexyl group and the like are preferable and the cyclohexyl group is more preferable.

Examples of the (a3) monovalent aromatic hydrocarbon group include a phenyl group and a toluyl group.

Examples of the (a4) divalent aromatic hydrocarbon group include a phenylene group, diphenylmethane group and tolylene group.

The (A) thickener is usually obtainable by reacting diisocyanate with monoamine.

Examples of diisocyanate include diphenylenediisocyanate, 4,4'-diphenylmethanediisocyanate and tolylenediisocyanate, among which diphenylmethanediisocyanate is preferable in view of low harmful effect.

Examples of the monoamine include amines corresponding to the (a1) chain hydrocarbon group, the (a2) alicyclic hydrocarbon group and the (a3) aromatic hydrocarbon group. Examples of the amines include a chain hydrocarbon amine such as octyl amine, dodecyl amine, octadecyl amine and octadecenyl amine, an alicyclic hydrocarbon amines such as cyclohexyl amine, an aromatic hydrocarbon amines such as aniline and toluidine and mixed amines in which these amines are mixed.

In the exemplary embodiment, a ratio of each of the hydrocarbon groups of $R^1$ and $R^3$ that are terminal groups of the diurea compound (the (A) thickener) depends on a composition of a material amine. The composition of the material amine (or mixed amine) for forming $R^1$ and $R^3$ is preferably a mixture of an amine having a chain hydrocarbon group and an amine having an alicyclic hydrocarbon group in terms of a lubricity lifetime of a bearing. Alternatively, a mixture of the above amines is preferable in terms of long heat-resistant lifetime.

In the formula (1), 60 mass % to 95 mol % of the hydrocarbon groups represented by $R^1$ and $R^3$ is preferably the (a2) monovalent alicyclic hydrocarbon group having 6 to 12 carbon atoms, further preferably a cyclohexyl group. The rest of the hydrocarbon groups represented by $R^1$ and $R^3$ is preferably the (a1) monovalent chain hydrocarbon group having 6 to 22 carbon atoms, preferably 10 to 22 carbon atoms, more preferably 15 to 22 carbon atoms, in terms of heat resistance, high-temperature fluidity and oil separation.

The content of the thickener (component (A)) is not limited as long as the thickener can form and keep the form of grease together with the base oil (component (B)). However, in terms of fluidity and low-temperature properties of the grease composition, the content of the thickener is preferably in a range from 5 mass % to 25 mass %, more preferably from 10 mass % to 20 mass % based on the total amount of the grease composition. When the content of the thickener is less than the lower limit, a desirable worked penetration tends not to be obtained. On the other hand, when the content of the thickener exceeds the upper limit, lubricity of the grease composition tends to be reduced.

Component B

As the (B) base oil to be used in the present composition, a typical base oil to be supplied to a lubricating oil, such as a (b1) polyalphaolefin (PAO), a (b2) ester (e.g., polyol ester) and mineral oil (e.g., paraffinic mineral oil), is usable. Among the above, the (b1) PAO and a mixture of the (b1) PAO and the (b2) ester are preferable in terms of long heat-resistant lifetime.

The (b1) PAO is a polymer (oligomer) of an alphaolefin. The alphaolefin (i.e. the monomer) preferably has 6 to 20 carbon atoms, more preferably 8 to 16 carbon atoms, particularly preferably 10 to 14 carbon atoms in terms of a viscosity index and low vaporized properties. The PAO is preferably dimer, trimer, tetramer and pentamer of the alphaolefin in terms of a low vaporized properties and energy-saving performance. It is only necessary to adjust the number of carbon atoms of the alphaolefin, a blend ratio thereof and a polymerization degree thereof according to target properties of PAO.

As a polymerization catalyst of the alphaolefin, a $BF_3$ catalyst, $AlCl_3$ catalyst, Ziegler type catalyst, metallocene catalyst and the like are usable. Though the $BF_3$ catalyst is typically used for a low viscous PAO having a kinematic viscosity at 100 degrees C. of less than 30 $mm^2/s$, and the $AlCl_3$ catalyst is typically used for a PAO having a kinematic viscosity at 100 degrees C. of 30 $mm^2/s$ or more, the $BF_3$ catalyst and the metallocene catalyst are especially preferable in terms of low vaporized properties and energy-saving performance. The $BF_3$ catalyst is used together with a promoter such as water, alcohol and esters, among which alcohol, especially 1-butanol, is preferable in terms of the viscosity index, low-temperature physical properties and a yield rate.

As the (b2) ester, a polyol ester, aliphatic diester and aromatic ester are preferably usable.

Examples of the polyol ester include an ester of aliphatic polyol and linear or branched fatty acid. Examples of the aliphatic polyol forming the polyol ester include neopentyl glycol, trimethylolpropane, ditrimethylolpropane, trimethylolethane, ditrimethylolethane, pentaerythritol, dipentaerythritol, and tripentaerythritol. Fatty acid having 4 to 22 carbon atoms may be employed. Examples of the particularly preferable fatty acid include butanoic acid, hexanoic acid, pelargonic acid, capric acid, undecylic acid, lauric acid, myristic acid, palmitic acid, oleic acid, stearic acid, isostearic acid and tridecyl acid. Partial ester of the above-noted aliphatic polyol and linear or branched fatty acid may also be employed. This partial ester can be obtained by reaction of aliphatic polyol and fatty acid accompanied by suitable adjustment of a reaction mol number.

The polyol ester preferably has a kinematic viscosity at 100 degrees C. in a range from 1 $mm^2/s$ to 50 $mm^2/s$, more preferably in a range from 2 $mm^2/s$ to 40 $mm^2/s$, particularly preferably in a range from 3 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under low temperatures.

The aliphatic diester is preferably an aliphatic dibasic acid diester. A carboxylic acid content of the aliphatic dibasic acid diester is preferably linear or branched aliphatic dibasic acid having 6 to 10 carbon atoms. Specific examples include adipic acid, pimelic acid, suberic acid, azelaic acid, sebacic acid, and others that have the same property as these. An alcohol content preferably is aliphatic alcohol having 6 to 18 carbon atoms. Specific examples include hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, and isomers thereof.

The aliphatic diester preferably has a kinematic viscosity at 100 degrees C. in a range from 1 $mm^2/s$ to 50 $mm^2/s$, more preferably in a range from 1.5 $mm^2/s$ to 30 $mm^2/s$, particularly preferably in a range from 2 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under low temperatures.

Usable examples of the aromatic ester include esters of alcohol and various types of aromatic carboxylic acid such as aromatic monobasic acid, aromatic dibasic acid, aromatic tribasic acid and aromatic tetrabasic acid. Examples of the aromatic dibasic acid include phthalic acid and isophthalic acid. The aromatic tribasic acid is exemplified by trimellitic acid. The aromatic tetrabasic acid is exemplified by pyromellitic acid. Specifically, aromatic ester oil such as trimellitic acid trioctyl, trimellitic acid tridecyl and pyromellitic acid tetraoctyl is preferable.

The aromatic ester preferably has a kinematic viscosity at 100 degrees C. in a range from 1 $mm^2/s$ to 50 $mm^2/s$, more preferably in a range from 1.5 $mm^2/s$ to 30 $mm^2/s$, particularly preferably in a range from 2 $mm^2/s$ to 20 $mm^2/s$. When the kinematic viscosity at 100 degrees C. is 1 $mm^2/s$ or more, evaporation loss is small. When the kinematic viscosity at 100 degrees C. is 50 $mm^2/s$ or less, energy loss due to viscosity resistance is restricted, thereby improving start-up performance and rotational performance under low temperatures.

The above-described polyol ester, aliphatic diester and aromatic ester may be each independently mixed with the above-described PAO, may be mixed together with the PAO, or may be used as a complex ester. The complex ester is an ester synthesized from polybasic acid and polyol, usually including monobasic acid. In the exemplary embodiment, the complex ester preferably used may be formed from: aliphatic polyol; and linear or branched aliphatic monocarboxylic acid having 4 to 18 carbon atoms, linear or branched aliphatic dibasic acid, or aromatic dibasic acid, tribasic or tetrabasic acid.

Examples of the aliphatic polyol used for forming the complex ester include trimethylolpropane, trimethylolethane, pentaerythritol, and dipentaerythritol. The aliphatic monocarboxylic acid may be aliphatic monocarboxylic acid having 4 to 18 carbon atoms, examples of which include heptadecylic acid, stearic acid, nonadecanoic acid, arachic acid, behenic acid, and lignoceric acid. Examples of the aliphatic dibasic acid include succinic acid, adipic acid, pimelic acid, suberic acid, azelaic acid, sebacic acid, undecanedioic acid, dodecanedioic acid, tridecanedioic acid, carboxylic octadecane acid, carboxymethyl octadecane acid, and docosanedioic acid.

As an esterification reaction for producing the above-described esters, it is only necessary to react alcohol (e.g., monohydric alcohol or polyol) with carboxylic acid (e.g., monobasic acid or polybasic acid) in a predetermined ratio. Alternatively, the above alcohol and carboxylic acid may be partially esterified and subsequently the partially esterified compound and carboxylic acid may be reacted. The acids may be reacted in a reverse order or mixed acids may be used in the esterification reaction.

The (B) base oil is preferably a base oil mixture of the (b1) PAO and the (b2) ester. The mass ratio of the PAO and the ester in the base oil mixture is preferably in a range from 5:95 to 95:5, more preferably in a range from 50:50 to 93:7, particularly preferably in a range from 70:30 to 90:10.

The base oil mixture preferably has a kinematic viscosity at 100 degrees C. in a range from 1 $mm^2/s$ to 30 $mm^2/s$, more preferably from 2 $mm^2/s$ to 20 $mm^2/s$. When the kinematic viscosity at 100 degrees C. is 1 $mm^2/s$ or more, lubricity is excellent and evaporation loss is small. When the kinematic viscosity at 100 degrees C. is 30 $mm^2/s$ or less, energy loss due to viscosity resistance is restricted, thereby improving start-up performance and rotational performance under low temperatures.

Other Additive Components

The present composition may be blended with various additives below as long as the advantages of the invention are not impaired. Examples of the various additives include a viscosity increasing agent, viscosity index improver, antioxidant, surfactant or demulsifier, antifoaming agent, rust inhibitor, extreme pressure agent, antiwear agent and metal deactivator. Examples of the viscosity increasing agent and the viscosity index improver include olefin oligomer such as polybutene, polyisobutylene and co-oligomer of 1-decene and ethylene, olefin copolymer (OCP), polymethacrylate and hydrogenated styrene-isoprene copolymer. A content of the additive(s) is preferably 10 mass % or less of the total amount of the composition.

Manufacturing Method of Present Composition

The present composition can be manufactured, for instance, by a manufacturing method below, but the manufacturing method of the present composition is not limited thereto.

Specifically, the present composition (urea grease) can be manufactured by reacting isocyanate with a predetermined amount of an amine in the base oil. The reaction is conducted by adding an amine solution in which an amine is dissolved in the base oil to an isocyanate solution in which isocyanate is dissolved in the base oil. Alternatively, in a reverse order, the reaction is conducted by adding the isocyanate solution to the amine solution. When the isocyanate solution or the amine solution is added, an opening diameter of a drip opening through which the solution is added is preferably in a range of 1 mm to 30 mm, more preferably in a range of 2 mm to 5 mm. When the opening diameter of the drip opening is 1 mm or less, since it is necessary to feed the solution by pressure-feeding or the like for more efficient manufacture, an efficient manufacture with typical equipment tends to be difficult. On the other hand, when the opening diameter of the drip opening exceeds the above upper limit, a dispersion condition of the isocyanate solution and the amine solution in contact with each other is deteriorated, so that the thickener is liable to be crystallized to deteriorate noise characteristics. Though an addition rate of the solution is not particularly limited, the addition rate falling within a range achievable with typical manufacturing equipment without pressure-feeding is sufficient. The number of the drip opening may be increased depending on an added amount of the solution and a time duration of adding the solution. When one of the isocyanate solution or the amine solution is added, the other solution is preferably stirred in advance. A temperature of the amine solution is preferably in a range from 50 degrees C. to 80 degrees C. A temperature of the isocyanate solution is preferably in a range from 50 degrees C. to 80 degrees C. A reaction temperature between the amine and the isocyanate is preferably in a range from 60 degrees C. to 120 degrees C.

EXAMPLE(S)

Next, examples of the invention will be described below in detail. However, it should be noted that the scope of the invention is by no means limited by the examples. In Examples and Comparatives, the following PAO, base oil mixture and additives were used. PAO (polyalphaolefin): kinematic viscosity at 40 degrees C. of 46.7 $mm^2/s$, kinematic viscosity at 100 degrees C. of 7.8 $mm^2/s$, and viscosity index of 137

Base oil mixture: a mixture prepared by mixing the PAO, aromatic ester and viscosity increasing agent at the room temperature Additives: a rust inhibitor, antioxidant and the like Example 1

A grease composition in a blend composition shown in Table 1 below was prepared from the base oil mixture, a precursor of the thickener and the additives by a method described below.

Firstly, isocyanate(diphenylmethane-4,4'-diisocyanate) was dissolved by heat in the base oil mixture to prepare an isocyanate solution. A mixed amine having moles twice as much as the amount of the isocyanate was dissolved by heat in the base oil mixture to prepare an amine solution A. The mixed amine is a mixture of (a1) octadecyl amine and (a2) cyclohexyl amine in a molar ratio between (a1) and (a2) of 20:80.

The amine solution A was added to the isocyanate solution for reaction at an average addition rate of 250 mL/minute from 15 drip openings having a 3-mm opening diameter. After all the amount of the amine solution A was added for the reaction, the mixture was heated to 160 degrees C. and was vigorously stirred for another one hour while being kept at 160 degrees C.

Next, after the mixture was cooled to 80 degrees C. at a cooling rate of 50 degrees C./hour, the additives were added. After the mixture was naturally cooled down to the room temperature, the mixture was subjected to a milling treatment and a defoaming treatment to obtain a grease composition.

A transmission image of the obtained grease composition was observed with the optical microscope (see FIG. 1). A transmission-image-area ratio of an aggregation part having a transmission image area exceeding 40 $\mu m^2$ in the urea thickener was calculated. The obtained results are shown in Table 1.

Example 2

A grease composition in a blend composition shown in Table 1 below was prepared from the base oil mixture, a precursor of the thickener and the additives by a method described below.

Firstly, the isocyanate solution and the amine solution A were prepared in the same manner as in Example 1.

The amine solution A was added to the isocyanate solution for reaction at an average addition rate of 250 mL/minute from a single drip opening having a 30-mm opening diameter. After all the amount of the amine solution A was added for the reaction, the mixture was heated to 160 degrees C. and was vigorously stirred for another one hour while being kept at 160 degrees C.

Next, after the mixture was cooled to 80 degrees C. at a cooling rate of 50 degrees C./hour, the additives were added. After the mixture was naturally cooled down to the room temperature, the mixture was subjected to a milling treatment and a defoaming treatment to provide a grease composition.

A transmission image of the obtained grease composition was observed with the optical microscope. A transmission-image-area ratio of an aggregation part having a transmission image area exceeding 40 $\mu m^2$ in the urea thickener was calculated. The obtained results are shown in Table 1.

Comparative 1

A grease composition in a blend composition shown in Table 1 below was prepared from the base oil mixture, a precursor of the thickener and the additives by a method described below.

Firstly, the isocyanate solution and the amine solution A were prepared in the same manner as in Example 1.

The amine solution A was added to the isocyanate solution for reaction at an average addition rate of 200 mL/minute from a single drip opening having a 70-mm opening diameter. After all the amount of the amine solution A was added for the reaction, the mixture was heated to 160 degrees C. and was vigorously stirred for another one hour while being kept at 160 degrees C.

Next, after the mixture was cooled to 80 degrees C. at a cooling rate of 50 degrees C./hour, the additives were added. After the mixture was naturally cooled down to the room temperature, the mixture was subjected to a milling treatment and a defoaming treatment to provide a grease composition.

Figure 2:
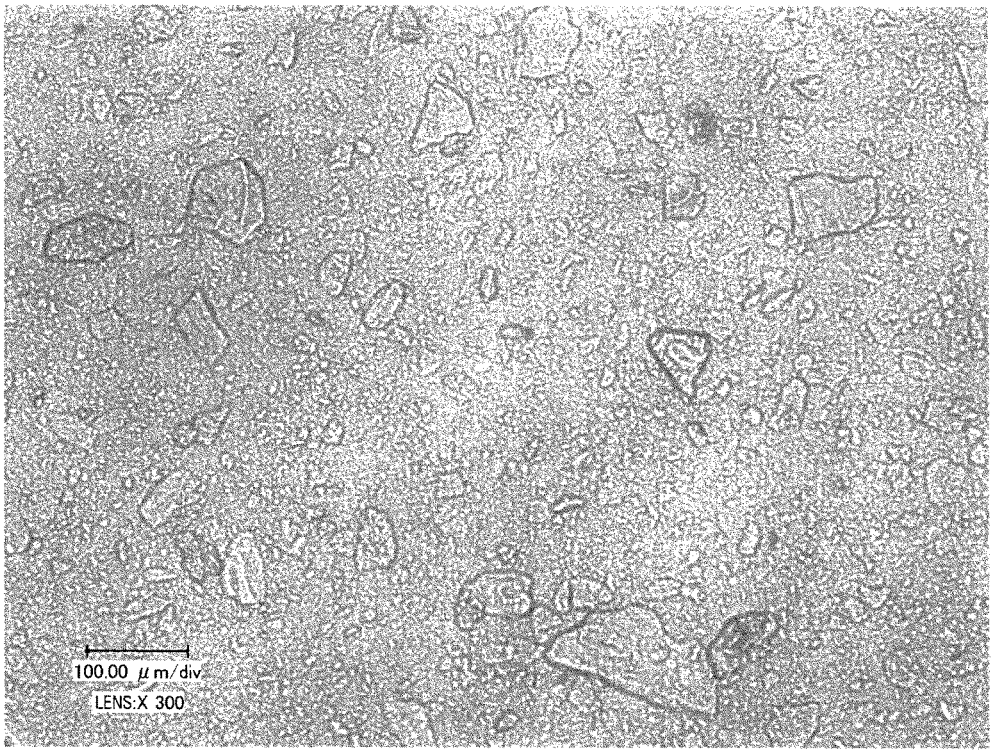
FIG. 2 is a photograph of a transmission image of a grease composition obtained in Comparative 1, which is taken by the optical microscope.

A transmission image of the obtained grease composition was observed with the optical microscope (see FIG. 2). A transmission-image-area ratio of an aggregation part having a transmission image area exceeding 40 $\mu m^2$ in the urea thickener was calculated. The obtained results are shown in Table 1.

Comparative 2

A grease composition in a blend composition shown in Table 1 below was prepared from the base oil mixture, a precursor of the thickener and the additives by a method described below.

Firstly, isocyanate(diphenylmethane-4,4'-diisocyanate) was dissolved by heat in the base oil mixture to prepare an isocyanate solution. A mixed amine having moles twice as much as the amount of the isocyanate was dissolved by heat in the base oil mixture to prepare an amine solution B. The mixed amine is a mixture of (a1) octadecyl amine and (a2) cyclohexyl amine in a molar ratio between (a1) and (a2) of 60:40.

The amine solution B was added to the isocyanate solution for reaction at an average addition rate of 200 mL/minute from a single drip opening having a 70-mm opening diameter. After all the amount of the amine solution B was added for the reaction, the mixture was heated to 160 degrees C. and was vigorously stirred for another one hour while being kept at 160 degrees C.

Next, after the mixture was cooled to 80 degrees C. at a cooling rate of 50 degrees C./hour, the additives were added. After the mixture was naturally cooled down to the room temperature, the mixture was subjected to a milling treatment and a defoaming treatment to obtain a grease composition.

A transmission image of the obtained grease composition was observed with the optical microscope. A transmission-image-area ratio of an aggregation part having a transmission image area exceeding 40 $\mu m^2$ in the urea thickener was calculated. The obtained results are shown in Table 1.

Evaluation of Grease Composition

The grease compositions were evaluated in terms of a worked penetration, bearing noise and bearing lifetime according methods below. The obtained results are shown in Table 1.

(1) Worked Penetration

The worked penetration was measured by a method defined according to JIS K2220.

(2) Bearing Noise

A bearing noise test was conducted using an Anderon meter under the following conditions to measure Anderon values.

Bearing Model: 6202

Grease Feed Amount: 0.7 g

Thrust Load: 19.6 N

Rotation Speed: 1800 rpm

Test Duration: 1 minute

The bearing noise of each of the grease compositions was represented by points based on the obtained Anderon values. 100 points shows perfection. The higher points show more excellent low-noise performance. It should be noted that a grease composition at 60 points or more is often used as a low-noise grease in terms of practical application.

(3) Bearing Lifetime

Under the following conditions, a bearing lifetime test was conducted by a method defined according to ASTM D1741. A time after reaching the bearing lifetime was measured and the time was indicated. Testing time of 2000 hours or more was regarded as satisfactory and denoted by "2000<".

Bearing Model: 6306

Rotation Speed: 3500 rpm

Testing Temperature: 150 degrees C.

Testing Load: radial load of 221 N, axial load of 178 N

Operation Condition: continuous operation

TABLE 1

| | | | Example 1 | Example 2 | Comparative 1 | Comparative 2 |
|---|---|---|---|---|---|---|
| manufacturing conditions | blend composition of grease composition (mass %) | (A) isocyanate | 6.74 | 6.74 | 6.74 | 5.35 |
| | | (a1) octadecyl amine | 2.81 | 2.81 | 2.81 | 6.71 |
| | | (a2) cyclohexyl amine | 4.15 | 4.15 | 4.15 | 1.64 |
| | | (B) base oil mixture | 80.7 | 80.7 | 80.7 | 80.7 |
| | | additive | 5.6 | 5.6 | 5.6 | 5.6 |
| | molar ratio between (a1) component and (a2) component (as1:a2) | | 80:20 | 80:20 | 80:20 | 40:60 |
| | opening diameter (mm) of drip opening | | 3 | 30 | 70 | 70 |
| evaluation results | transmission-image-area ratio (%) | | 7.6 | 14.2 | 20.0 | 29.0 |
| | worked penetration | | 265 | 236 | 245 | 250 |
| | bearing noise test | | 80 | 62 | 24 | 50 |
| | bearing lifetime test (hours) | | 2000< | 2000< | 2000< | 797 |

As obvious from the results shown in Table 1, it was observed that, with use of the grease composition of the invention (Examples 1 and 2), both of the low-noise performance and long lubricity lifetime of the bearing at high temperatures were achieved.

On the other hand, at an excessively high transmission-image-area ratio (Comparative 1), the low-noise performance was revealed to be insufficient.

Moreover, in Comparative 2, it was observed that the results of the bearing lifetime test were significantly below the satisfactory hours. In Comparative 2, it was also observed that the results of the bearing noise test showed higher points than those in the results in Comparative 1. It is considered that the above results are caused by the urea thickener of Comparative 2 containing a less crystallizable aliphatic amine as a main component.

The invention claimed is:

1. A composition comprising:

an (A) thickener; and a (B) base oil, wherein the (A) thickener is a urea thickener represented by formula (1):

$$R^1NHCONHR^2NHCONHR^3 \quad (I)$$

where $R^1$ and $R^3$ each independently represent a hydrocarbon group selected from the group consisting of an (a1) monovalent chain hydrocarbon group having 6 to 22 carbon atoms; an (a2) monovalent alicyclic hydrocarbon group having 6 to 12 carbon atoms; and an (a3) monovalent aromatic hydrocarbon group having 6 to 12 carbon atoms, and $R^2$ represents an (a4) divalent aromatic hydrocarbon group having 6 to 15 carbon atoms, and wherein a $2\times10^6$ $\mu m^2$ portion of a transmission image in a sample with an average thickness of 11 μm observed with an optical microscope at 300× magnification has a transmission-image-area ratio of an aggregation part having a transmission image area exceeding 40 $\mu m^2$ relative to a transmission image area of the $2\times10^6$ $\mu m^2$ portion of the sample of 15% or less.

2. The composition according to claim 1, wherein the (a2) monovalent alicyclic hydrocarbon group accounts for 60 mol % to 95 mol % of a total amount of the hydrocarbon groups represented by $R^1$ and $R^3$.

3. The composition according to claim 2, wherein the (a2) monovalent alicyclic hydrocarbon group is a cyclohexyl group, and the rest of the hydrocarbon groups represented by $R^1$ and $R^3$ not accounted for by the cyclohexyl group is the (a1) monovalent chain hydrocarbon group.

4. The composition according to claim 1, wherein the (B) base oil is a mixture of a (b1) polyalphaolefin and a (b2) ester.

5. The composition according to claim 4, wherein a content of the (b1) polyalphaolefin is in a range of 50 mass % to 95 mass % relative to the (B) base oil of 100 mass %.

6. The composition according to claim 5, wherein the (b2) ester is an aromatic ester.

7. The composition according to claim 1, having a worked penetration of 200 to 380.

8. A method for lubricating a bearing of an auxiliary machine in an internal combustion engine, comprising:

applying the composition according to claim 1 to the bearing.

9. The composition according to claim 1, wherein the transmission-image-area ratio is 10% or less.

10. The composition according to claim 1, wherein the transmission-image-area ratio is 8% or less.

11. The composition according to claim 1, which is in the four of a bearing grease adapted for bearings of auxiliary machines.

12. The composition according to claim 1, which is obtained by mixing an isocyanate and an amine in the base oil, and reacting the isocyanate and the amine to form the (A) thickener.

13. The composition according to claim 12, wherein the isocyanate is diphenyhnethane-4-4'-diisocyanate.

14. The composition according to claim 13, wherein the amine is at least one selected from the group consisting of octadecylamine and cyclohexylamine.

15. The composition according to claim 1, having a bearing noise measured with an Anderon meter with a bearing model 6202, a grease feed amount of 0.7 g, a thrust load of 19.6N, a rotation speed of 1,800 rpm, and a test duration of one minute of from 62 to 80.

16. The composition according to claim 1, having a worked penetration of from 236 to 265 according to JIS K2220.

17. The composition according to claim 12, wherein the amine is added dropwise to the base oil which is a mixture with the isocyanate, and wherein the amine is added as a solution in the base oil through an opening having an opening diameter of from 3 to 30 mm.

* * * * *